US005716662A

United States Patent [19]

Fitzburgh

[11] Patent Number: 5,716,662

[45] Date of Patent: Feb. 10, 1998

[54] METHOD FOR WAXING SNOWBOARDS, SKIS AND THE LIKE

[76] Inventor: Brian Fitzburgh, 2965 Waverly Dr. #2, Los Angeles, Calif. 90039

[21] Appl. No.: 706,640

[22] Filed: Sep. 6, 1996

Related U.S. Application Data

[60] Continuation of Ser. No. 427,568, Apr. 24, 1995, abandoned, which is a division of Ser. No. 307,298, Sep. 16, 1994, abandoned.

[51] Int. Cl.[6] ..... H05B 3/00; H05B 3/34; B32B 35/00

[52] U.S. Cl. ..... 427/8; 427/592; 427/140; 427/142; 427/416; 427/358; 219/486; 219/528

[58] Field of Search ..... 427/8, 545, 592, 427/140, 148, 384, 388.1, 393, 393.4, 393.5, 397, 416, 142, 156, 358; 118/699, 712, 59, 76, 101, 202; 156/583.1, 583.3; 219/544, 528, 549, 486

[56] References Cited

U.S. PATENT DOCUMENTS

| | | | |
|---|---|---|---|
| 3,549,461 | 12/1970 | Bennett | 156/583 |
| 3,904,850 | 9/1975 | Johnson | 219/528 |
| 4,108,713 | 8/1978 | Weisz | 219/243 |
| 4,182,786 | 1/1980 | Hertel | 427/428 |
| 4,308,633 | 1/1982 | Van Huffel et al. | 427/148 |
| 4,445,025 | 4/1984 | Metz | 219/530 |
| 4,468,557 | 8/1984 | Bylin et al. | 219/535 |
| 4,577,586 | 3/1986 | Morris et al. | 118/202 |
| 4,813,371 | 3/1989 | Dakof et al. | 118/202 |
| 4,923,560 | 5/1990 | Inselmann | 156/555 |
| 4,987,291 | 1/1991 | McGaffigan et al. | 219/549 |
| 5,004,190 | 4/1991 | Montierth | 246/428 |
| 5,012,758 | 5/1991 | Künzler | 118/264 |

*Primary Examiner*—Marianne Padgett

*Attorney, Agent, or Firm*—Hopgood, Calimafde, Kalil & Judlowe

[57] ABSTRACT

For efficient waxing of the running surface of a workpiece such as a snowboard, one or more skis, or a toboggan, the invention provides a single wax-heating element in the form of an elongate flexible sheet sized to fully cover the running surface when upside down and horizontally oriented. The single sheet of the heating element also provides articulating connection between an array of like transverse elements which gravitationally load the heating element sheet into self-adapting conformance with flat and convexly curved features of the workpiece, so that a wax-laden sheet draped over the running surface of the workpiece can be gravitationally loaded by the heating element sheet.

10 Claims, 3 Drawing Sheets

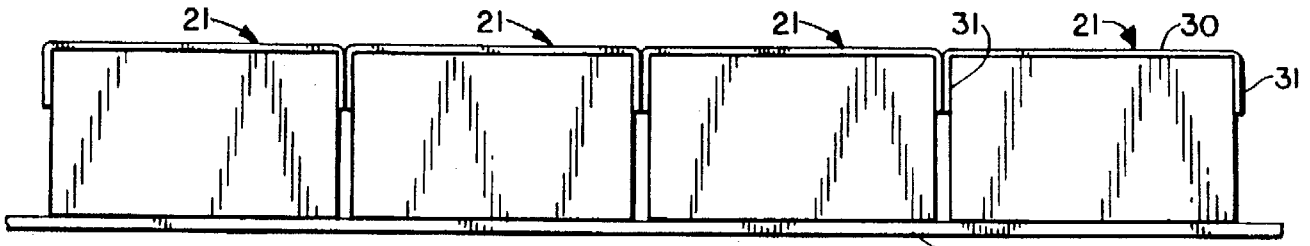
FIG.4
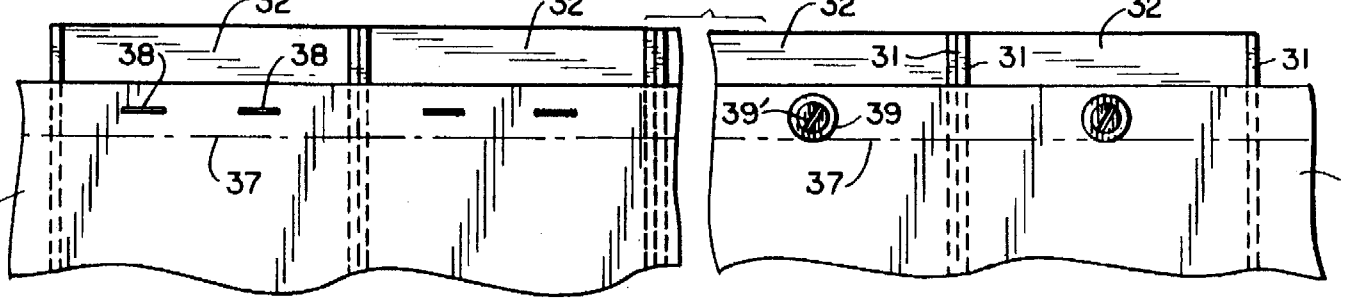
FIG.5A
FIG.5
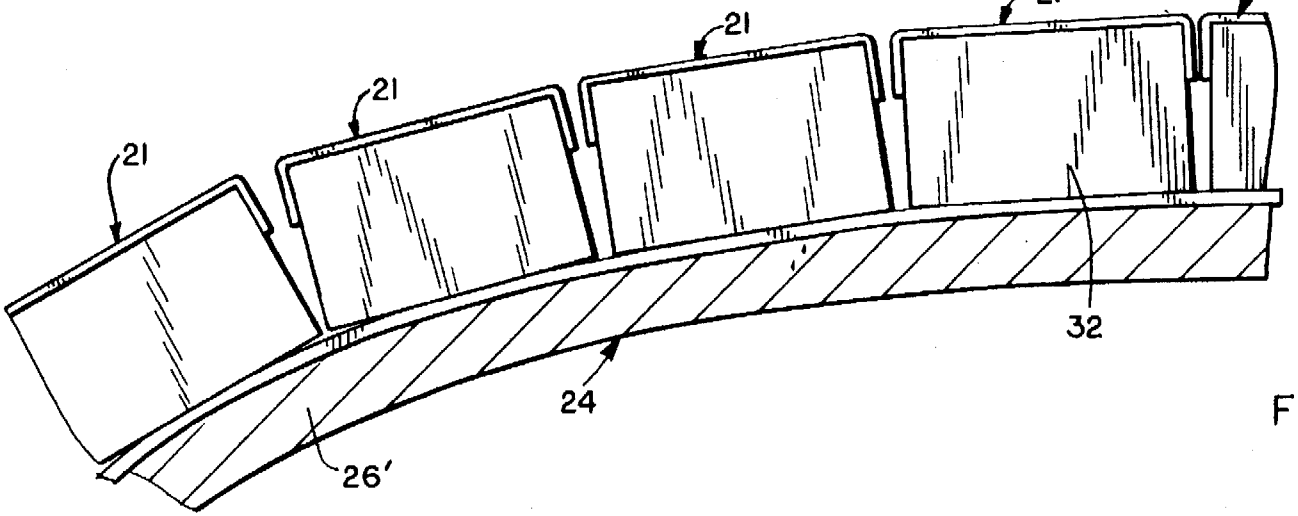
FIG.6

METHOD FOR WAXING SNOWBOARDS, SKIS AND THE LIKE

RELATED CASE

This application is a continuation of application Ser. No. 08/427,568, filed Apr. 24, 1995, now abandoned, which is a division of application Ser. No. 08/307,298, filed Sep. 16, 1994, now abandoned.

BACKGROUND OF THE INVENTION

This invention relates to application of a wax to a surface and more particularly to an improved means and method of applying wax to snowboards, snow skis, toboggans or other articles of manufacture.

Some commonly used techniques, such as hand application for ski waxing, apply several times as much wax as is actually necessary. This excess wax is then, after being applied, scraped off and discarded. As a consequence, the removed wax presents possible shop hazards, a mess, and obviously a great waste of wax. Current methods which are effective are either laborious or involve expensive professional equipment. The problems with ski waxing are compounded for devices such as snowboards and toboggans, which have much greater areas to be serviced with wax.

U.S. Pat. No. 4,308,633 proposes to solve the problem of waste, by providing a multilayer wax-impregnated carrier element which may be heat-applied, as by a flat iron, to the running bottom surface of a ski, the carrier element being removed while the wax is still hot.

Further, a wax-impregnated sheet product, available under the mark SKINS from its source having the trademark SKINS, has been gaining acceptance, again wherein a flat iron provides the source of heat needed to assure penetration of molten wax into the running surface being treated. But there is much handwork and therefore time consumption, not to mention personal skill and technique, that is required for a professional and high-quality waxing operation. The SKINS product relies on a wax absorptive carrier such as a sheet of cloth or of a synthetic material which has been prepared with wax to essentially only the density (i.e., quantity of releasable wax, per unit area) that a ski bottom can be expected to absorb. The sheet is cut to length as appropriate, and a hot household flat iron is the recommended means of wax release to the point of saturating the ski bottom, thus leaving only a thin, uniform layer of wax on the ski bottom. This product and technique thus eliminate the need to scrape off any excess of applied wax, and the mess and waste of the past are avoided. But, as noted above, the work is largely by hand, and requires more time and skill than is desired.

BRIEF STATEMENT OF THE INVENTION

It is an object of the invention to provide an improved method and means of applying wax to skis and other articles of the character indicated.

It is a specific object to provide heating apparatus which is able to perform the necessary wax melting and penetration involved in wax treatment of an entire ski surface, snowboard surface or the like in a single operation.

Another specific object is to meet the above object with apparatus which will perform the full-surface treatment of an article of the character indicated, as a completely automatic operation, in a minimum of time and with enhanced assurance of a quality job.

A general object is to achieve the above objects with apparatus requiring a minimum of personal skill and at a substantial saving of cost, as compared with practices to date.

The invention achieves the foregoing objects by providing a fresh suitably wide, wax-laden sheet which may be cut to the length of an article or workpiece to be waxed, the article being elongate and supported upside-down so that its running surface is generally horizontal and face-up. For skis, snowboards, toboggans and the like, the leading end is curved and in the indicated upside-down condition, the running surface to be waxed is generally flat except for the downward convex curve of its leading end. The wax-laden sheet is draped over the full extent of the running surface to be waxed, a flexible electric heating element is positioned over the wax-laden sheet, and a longitudinally flexible articulated series of like transverse members applies a uniformly distributed loading of the heating element and wax-laden sheet to the entire running surface. Control for the heating element involves presettable timing and monitored temperature distribution, to the end that wax impregnation in a single operation is optimized, for the particular running surface to be serviced; whereupon, the articulated structure and heating element are lifted enough to clear the substrate from which wax was transferred to the running surface of the workpiece. A squeegee that is manipulated over any remnant molten wax (following substrate removal) will produce a beautifully smooth running surface finish to the serviced workpiece.

BRIEF DESCRIPTION OF THE DRAWINGS

A preferred embodiment of the invention will be described in detail in conjunction with the accompanying drawings, in which:

FIG. 4 is an enlarged fragmentary side elevation of articulated adjacent elements of FIG. 2, in horizontal array and at the horizontal upper limit of their range of articulation;

FIG. 5 is a plan view of the elements of FIG. 4 and their relation to a fragment of the associated heating element;

FIG. 5A is a view similar to FIG. 5 to show a modification;

FIG. 6 is a view similar to FIG. 4, to show articulated adjacent elements of FIG. 2 in self-adapted conformance to an upwardly facing convexly curved workpiece surface.

DETAILED DESCRIPTION

Figure 1:
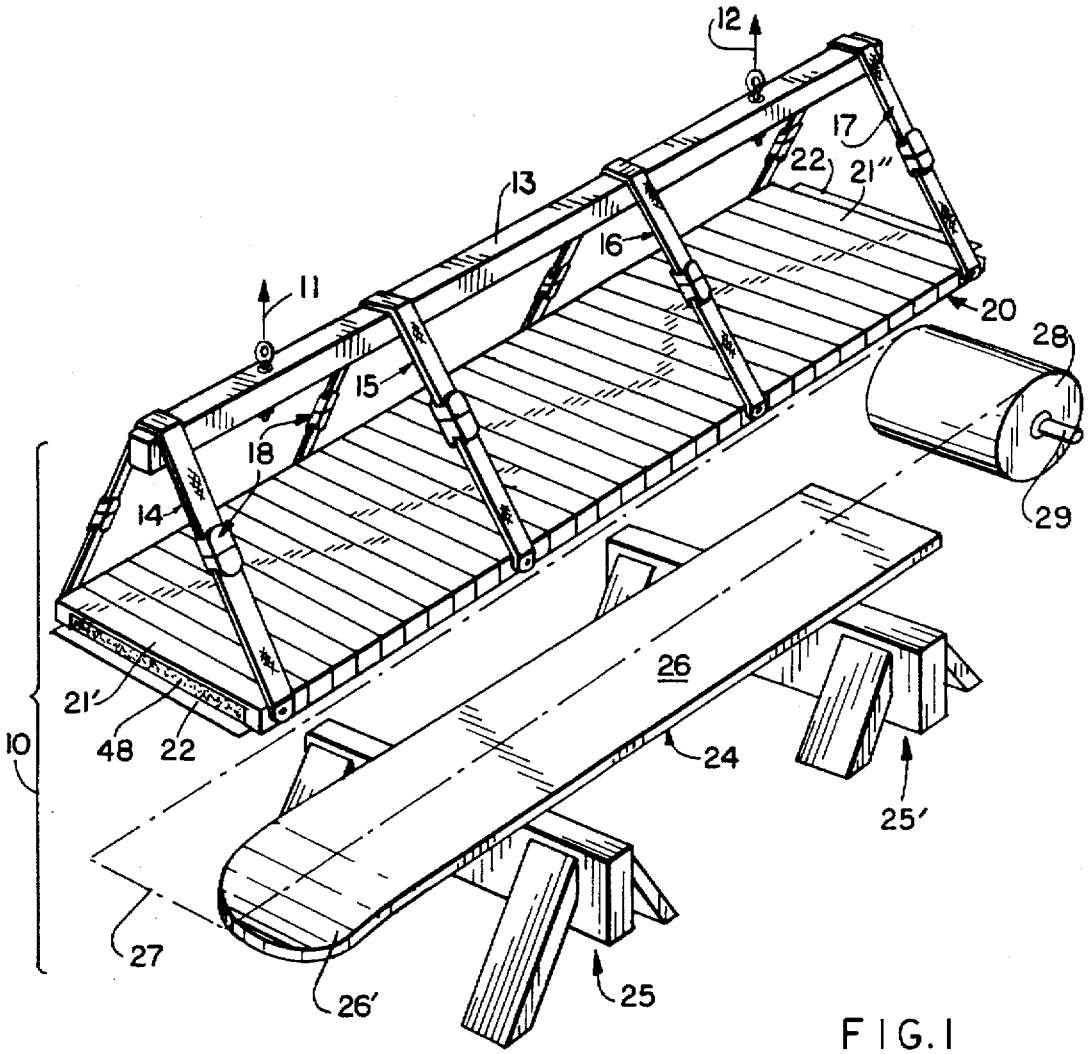
FIG. 1 is a simplified perspective view of waxing apparatus of the invention.

A general arrangement of separate components of the invention is presented in FIG. 1, and frame members which connect and support these components have been omitted for clarity of exposition, the overall connected interrelation of these components being merely suggested by all-embracing vertical bracketing 10, at the left margin of FIG. 1. Such frame members, or the crossbeam or joist of a room, will be understood to provide solid overhead referencing for one or more pulleys of a hoist system (suggested by suspension cables 11, 12) connected at spaced locations to an elongate horizontal suspension bar 13, by which four longitudinally spaced pairs of flexible straps (14, 15, 16, 17) in turn provide longitudinally distributed suspension of a heating element assembly which is generally designated 20.

As will later become clear, the heating element assembly 20 is an articulated succession of like transverse members 21 which, in the suspended condition of FIG. 1, are in their uppermost and most flattened condition of flexible articulation. Each of the straps (14, 15, 16, 17) is connected exclusively to the opposite ends of a single one of the transverse members 21, it being preferred that end straps 14, 17 be connected to transverse members 21' and 21" at the respective ends of the succession and that the remaining two straps (15, 16) be connected to intermediate transverse members so as to establish substantially uniform spacing between strap-connected transverse members. For convenience of packaging, inspection and maintenance, each suspension leg of each strap is shown with readily detachable engagement means 18. The heating element assembly carries a flexible electric heating panel or sheet 22 which in FIG. 1 is shown in the elevated position of assembly 20, above and in total longitudinal and transverse overlap of a workpiece 24.

Workpiece 24, which may be a snowboard, is shown supported upside-down, by and between longitudinally spaced saw horses 25, 25', thus upwardly presenting its bottom or running surface 26 for waxing treatment. It is noted that a snowboard may have symmetrically curved opposite ends, as for acrobatic or stunt uses of the snowboard, in which case the running surface 26 will have upwardly facing convexly curved ends; however, in many usages, and for present purposes, it is sufficient to show one such convex curvature at 26', namely, at the forward or leading contour of the workpiece.

Wax-impregnated or wax-coated substrate sheet material 27 is shown to be dispensable from a roll 28 that is mounted for rotation on a fixed horizontal axis, as provided by a shaft portion 29 of overall frame structure of the waxing apparatus. A length 27 of the wax-laden sheet is shown in FIG. 1 by phantom outline and will be understood to be cut to length, as appropriate, upon payout from roll 28 and draping over the entire running surface of workplace 26.

The above-indicated SKINS sheet material is commercially available in different-length rolls, of width sufficient for present-day snowboards; the largest of these is 1350-feet long, good for 250 snowboard-waxing jobs. If the "workpiece" is a pair of skis, the snowboard-width material is more than adequate to wax both skis of the same pair in a single operation. Alternatively, narrower SKINS sheet material of suitable width for wax application to individual skis is also available and will be understood to be dispensable from two adjacent supply rolls (not shown) on the same dispensing mount or shaft 29. Preferably, shaft 29 is cantilevered from a single frame-mounted end, thus allowing quick loading of rolls 28 for particular use, as appropriate.

When the wax-laden sheet 27 has been cut-off from roll 28 and draped to cover the entire running surface 26, the hoist mechanism (symbolized at 11, 12) is operated to lower the bar 13 and its suspended heating assembly 20, to the point of gravitationally loading the heating sheet 22 into essentially complete coverage of sheet 27, with conformance to both the flat and curved portions (26, 26') of the workpiece. This lowering should be to the extent of totally supporting the articulated structure on the snowboard, thus relieving bar 13 of any support function, and with all straps (14, 15, 16, 17) in slack condition.

Figure 2:
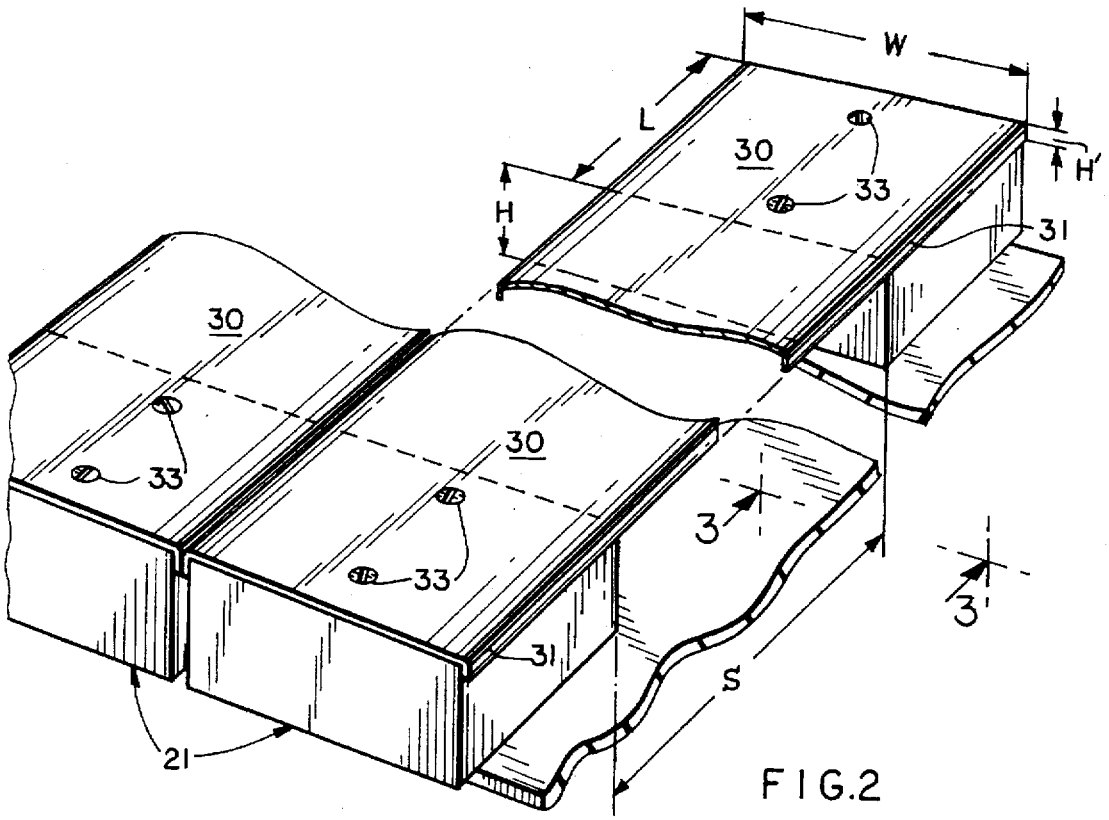
FIG. 2 is an enlarged fragmentary view in perspective to show detail of articulated adjacent elements in the apparatus of FIG. 1.

Directing attention now to FIGS. 2 to 6, the presently preferred construction of assembly 20 is seen to employ a longitudinal succession of like transversely oriented members 21 which are in abutting relation when assembly 20 is flat (FIGS. 2, 4 and 5). The overall cross-section of each element 21 is generally rectangular, wherein a flat upper surface is defined by the broad base 30 of an elongate metal channel member, suitably of formed 16-gauge aluminum sheet, with relatively short side walls 31 establishing a defined width W of each transverse member 21. Spacer blocks 32, suitably of hardwood such as oak or rock maple, are nested in the ends of the metal channel, with close back-up fit between and to the respective side walls 31 of the channel member. The end spacer blocks may be of length approximating the width dimension, and of thickness H substantially exceeding the height H' of the channel side walls 31, thus leaving a substantially greater transverse span S' between the end blocks 32 of each member 21. The spacer blocks 32 are shown secured to the ends of the channel by screws 33, and the generally rectangular section of each transverse member 21 is thus completed by the geometric plane established by the underside surfaces of the two spacer blocks 32 of each member 31.

Figure 3:
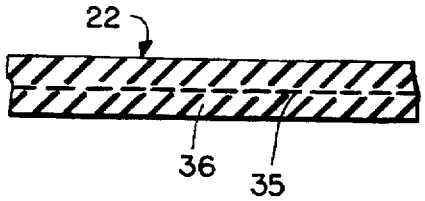
FIG. 3 is a further-enlarged sectional fragment of a heating element in the apparatus of FIG. 1, the section plane being generally designated 3—3 in FIG. 2.

The means of articulating interconnection of transverse members 21 is the flexible sheet 22 which is a composite containing electric heating means 35 (FIG. 3). For present purposes, it suffices to state preference that the electric resistance heating material of means 35 is a thin foil (an etched film) development which is embedded in an elastomeric body 36, suitably a silicone rubber containing glass fiber for resultant longitudinally flexible but essentially non-stretch properties in the sheet. The pattern of thin-film development, i.e., its effective "wiring" course over the area (or areas) of heat development can be generally as in electric blanket construction, except of course that the resistance "wires" are courses of flexible thin film. In the construction of sheet 22, it is important to note that the heating area of thin-film development is laterally short of the longitudinal edges of sheet 22, thus establishing an electrically inert margin (37, FIGS. 5, 5A) along each longitudinal edge of sheet 22. In FIG. 5, this marginal space is shown to enable staple fasteners 38 to be driven through sheet margins, for anchorage to the undersides of spacer blocks 32; in the alternative of FIG. 5A, a single wood screw 39, seated against a washer 39', suffices to retain sheet 22 to the transverse centerline of each end of each of the transverse members 21. Thus connected, whether in the manner of FIG. 5 or of FIG. 5A, successive members 21 firmly abut their channel sidewalls 31 in the flattened condition of FIG. 4; and the flexible interconnection of their lower surfaces enables gravitational self-adaptation to a convex contour, as at 26', thus achieving the relationship of FIG. 6.

Figure 7:
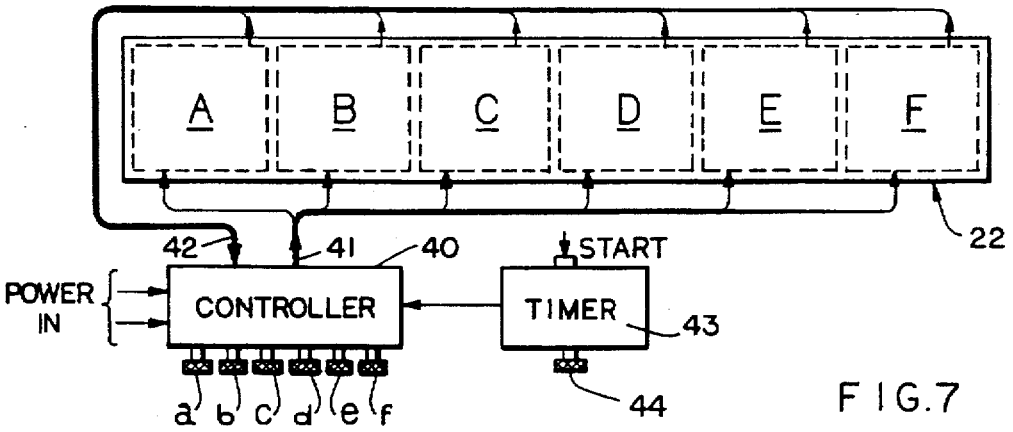
FIG. 7 is a schematic diagram of the heating element of FIG. 1, and control connections serving an array of multiple components of the heating element.

FIG. 7 schematically indicates a preferred layout of the composite heater sheet 22, wherein the described embedded foil (or etched film) 35 is developed independently in each of a plurality of successive zones, here shown as six zones A, B, C, D, E, F. Power supplied to a controller 40 is independently supplied to each of the respective zones via output lines collectively indicated at cable 41 of a flexible harness, and a corresponding number of adjustment elements a, b, c, d, e, f is shown for trimming the supply of electrical energy to the independent heating zones. In addition, another flexible harness configuration, collectively symbolized by a cable 42, supplies temperature-sensed electric signals, independently from each of the heating zones A, B, C, D, E, F, for feedback control of the individual heater-zone supplies, based on individual zone adjustments at a, b, c, d, e, f. It will be understood that the adjustments at a, b, c, d, e, f will be as appropriate for uniformly distributed melting release of wax from sheet 27 and for maximum impregnation of the workpiece running surface 26, 26'. Timing of the wax transfer and impregnation process is governed by suitable adjustment of a timer 43, as at 44, the adjusted time (following start via push button 45) being optimized by experience, for each of the different kinds of running surface 26, 26' to be treated, from one to the next customer.

It will be seen that the described apparatus and method meet all stated objects and provide for fast, efficient waxing in a single operation and with superior finish. The substrate may be left on the wax-impregnated running surface as a protection during snowboard or the like off-season storage; after storage, a simple "flash" heating is enough to enable the substrate of sheet 27 to be peeled off and any liquid wax at the running surface 26, 26' can be quickly smoothed by squeegee. On the other hand, once the described impregnation treatment has been ended by timer 43, and the heater assembly 20 has been hoisted (via means 11, 12), the substrate of sheet 27 is easily peeled off, and if necessary, surface 26, 26' can be smoothed by squeegee. Using the SKINS sheet material that is mentioned above, the heating apparatus and method of the described invention are able to perform a complete wax-impregnating job on a snowboard in five minutes or less, i.e., in approximately one-third the time of previous methods of hot-waxing a snowboard, namely, in five minutes, as compared to the 15 or 20 minutes previously required. In doing this, it is also important to note that the SKINS sheet contains the correct dosage of wax (i.e., wax content, per unit area) for a single treatment, so that excess wax does not present a problem.

Specific advantages of the invention can be summarized by item, as follows:

A. The heating assembly 20, now marketed under applicant's trademark TOASTER, is large enough to heat the entire bottom of a snowboard, or ski, or pair of skis, or toboggan, in a single operation which treats the entire area of running surface (26, 26'). For a typical snowboard 24, the dimensions of heating assembly 20 may be 13 inches wide by 73 inches long, thus allowing the heating surface of the flexible composite heating sheet 22 to be 12 inches by 72 inches, i.e., within electrically inert longitudinal-end and lateral-edge margins that are one-half inch wide.

B. The combination of the heating assembly (or "toaster") with a wax-laden sheet 27, such as the commercially available SKINS material enables users to perform better jobs with great savings in time and efficient use of wax.

C. The controller means 40 will be understood to contain a compact circuit board and microprocessor to assure continuous thermostatic monitoring and automatic control of heating in the respective heating zones, for uniformly distributed hot-wax impregnation of the workpiece surface (26, 26').

D. The articulation mechanics of the heating assembly 20 incorporates what may be called one-way hinging action, which allows bending away from a substantially flat upper limit (FIG. 4) when suspended at offset from the workpiece, the bending being downward in gravitational self-adaptation to convex curvature of the workpiece surface 26,26' to be waxed.

E. The heating sheet 22 per se, being a composite with embedded glass fiber reinforcement, is rendered thin and flexible while exhibiting such longitudinal resistance to stretch as to permit relatively great longitudinal spans between strap-supported transverse members 21. For example, for a member-width dimension W=2 inches, 36 members 21 will have articulated interconnection via sheet 22, but an essentially flat upper hinge relation (as in FIGS. 1 and 4) is achieved for the four longitudinal locations of flexible strap suspension, meaning that eight members 21 (between strap-connected members 21) are supported only by reason of the described adjacent sidewall abutments 31 and by reason of the essentially non-stretch property of sheet 22. And for the indicated width of two inches, an overall height H of one inch, and a sidewall height H' of one quarter inch, are suitably proportioned dimensions.

F. For the indicated dimensional relationships of the heating assembly 20, a continuous flexibly articulated passage is defined within the full length of assembly 20; this passage is laterally defined by span S' between the spacer end blocks 32 of each of the transverse members 21, and vertically between the base 30 of the metal channel and the flexible heating sheet 22. A flexible pad 48 of insulating material is visible in FIG. 1 and will be understood to be fully coextensive with the length of assembly 20, thus promoting convergence of heat delivery to the running surface that is being hot-waxed.

I claim:

1. A method of applying wax to a workpiece for use in snow, the workpiece having a longitudinally extending running-surface area which at least at one longitudinal end is of convex curvature, the workpiece being selected from the group consisting of snowboards, skis, and toboggans, which method comprises steps of:

(a) horizontally supporting the workpiece upside-down, with the running-surface area upwardly exposed;

(b) selecting a wax-laden sheet of substrate material of size to cover the running-surface area of the workpiece, and laying the wax-laden sheet over and on the running-surface area;

(c) selecting a longitudinally extending flexible sheet of electric heating material of size to cover the running-surface area, the flexible sheet of electric heating material being flexibly and generally horizontally suspended in spaced relation above and in overlapping register with the covered running-surface area;

(d) reducing the spaced relation in a vertically directional relative displacement of the suspended flexible sheet and of the supported workpiece with respect to each other until the flexible sheet of electric heating material is supported only by overlapping contact with the wax-laden sheet on the workpiece;

(e) energizing the heating material to a level and for a period of time to achieve melted-wax release from the substrate material onto the running-surface area, the heating material being energized by a plurality of energizing elements distributed over the running-surface area, each energized element defining an independent heating zone, so as to effect an even wax coating over the area; and (f) upon expiration of the period of time, removing the flexible sheet of electric heating material from supported relation to the workpiece and stripping the substrate material from the released wax on the workpiece running-surface area.

2. The method of claim 1, including subsequent step (g) of squeegee application over the surface area to smooth any melted wax that appears still to be liquid.

3. The method of claim 1, in which the selected flexible sheet of electric heating material is a bottom-surface component part of an articulated succession of separately rigid members which extend transverse to the longitudinal direction of the flexible sheet, wherein the articulation enables the members to gravitationally load the flexible sheet of electric heating material and the wax-laden sheet of the step (b) into local self-adapting conformance with the running-surface area of the workpiece.

4. The method of claim 1, wherein the period of time of the step (e) includes time to achieve wax impregnation of throughout the running-surface area of the workpiece.

5. A method of treating with wax a workpiece for use in snow, the workpiece having a longitudinally extending running-surface area which at least at one longitudinal end is of convex curvature, the workpiece being selected from the group consisting of snowboards, skis, and toboggans, which method comprises steps of:

(a) horizontally supporting the workpiece upside-down with the running-surface area upwardly exposed;

(b) positioning treatment wax, which is coated on or impregnated in a sheet material, to cover the running-surface area of the workpiece;

(c) selecting a longitudinally extending flexible sheet of electric heating material of size to cover the running-surface area, and placing the sheet of electric heating material in registering contact with and support by the wax-covered running-surface area;

(d) energizing the electric heating material to a level and for a period of time to achieve and to retain a melted state of the wax on the running surface area and over the period of time, the heating material being energized by a plurality of energizing elements distributed over the running-surface area, each energized element defining an independent heating zone, so as to effect an even wax coating over the area; and (e) upon expiration of the period of time, lifting the flexible sheet of heating material away from supported relation to the running-surface area of the workpiece and from melted wax on the running-surface area.

6. The method of claim 5, wherein the period of time of the step (d) includes time to achieve wax impregnation throughout the running-surface area of the workpiece.

7. The method of claim 6, in which the period of time is approximately five minutes or less.

8. The method of claim 5, including subsequent step (f) of squeegee application over the running-surface area to smooth any melted wax that appears still to be liquid.

9. The method of claim 5, in which the selected flexible sheet of electrical heating material is a bottom-surface component part of an articulated succession of rigid members which extend transverse to the longitudinal direction of the flexible sheet, wherein the articulation enables the members to gravitationally load the flexible sheet of electrical heating material into local self-adapting conformance with the running-surface area of the workpiece.

10. A method of treating with wax a workpiece for use in snow, the workpiece having a longitudinally extending running-surface area which at least at one longitudinal end is of convex curvature, the workpiece being selected from the group consisting of snowboards, skis, and toboggans, which method comprises steps of:

(a) horizontally supporting the workpiece upside-down with the running-surface area upwardly exposed;

(b) positioning treatment wax, which is coated on or impregnated in a sheet material, to cover the running-surface area of the workpiece;

(c) selecting a longitudinally extending flexible sheet of electric heating material of size to cover the running-surface area, and placing the sheet of electric heating material in registering contact with and support by the wax-covered running-surface area, the selected flexible sheet being selected for a succession of plural adjacent zones of heat development;

(d) energizing the electric heating material to a level and for a period of time to achieve and to retain a melted state of the wax on the running surface area and over the period of time, the heating material being energized by a plurality of energizing elements distributed over the running-surface area, each energized element defining an independent heating zone, so as to effect an even wax coating over the area, the energizing being based on thermostatic monitoring and automatic control of heating in the respective zones of heat development, for uniformly distributed melted-wax impregnation of the running-surface area of the workpiece; and (e) upon expiration of the period of time, lifting the flexible sheet of heating material away from supported relation to the running-surface area of the workpiece and from melted wax on the running-surface area.

* * * * *